United States Patent [19]

Fikse

[11] 4,190,294

[45] Feb. 26, 1980

[54] EXCAVATOR FOR USE IN A TUNNELING SHIELD

[75] Inventor: Tyman H. Fikse, Seattle, Wash.

[73] Assignee: The Robbins Company, Seattle, Wash.

[21] Appl. No.: 934,511

[22] Filed: Aug. 17, 1978

[51] Int. Cl.[2] ..... E21D 9/08

[52] U.S. Cl. ..... 299/33; 299/67

[58] Field of Search ..... 299/11, 33, 64, 67, 299/31; 214/133, 134, 131 A, 1 CM

[56] References Cited

U.S. PATENT DOCUMENTS

| | | | |
|---|---|---|---|
| 3,215,391 | 11/1965 | Storm | 248/179 X |
| 3,288,421 | 11/1966 | Peterson | 248/179 X |
| 3,404,920 | 10/1968 | Tabor | 299/33 |
| 3,556,599 | 1/1971 | Fikse | 299/11 |
| 3,578,809 | 5/1971 | Cunningham | 299/33 |
| 3,612,609 | 7/1971 | Reuls | 299/33 |
| 3,966,256 | 4/1975 | Fikse | 299/33 |
| 4,043,137 | 8/1977 | Jutte et al. | 299/31 X |
| 4,070,772 | 1/1978 | Motomura et al. | 173/46 X |

FOREIGN PATENT DOCUMENTS

| | | | |
|---|---|---|---|
| 2437669 | 2/1976 | Fed. Rep. of Germany | 299/11 |

*Primary Examiner*—Ernest R. Purser

*Attorney, Agent, or Firm*—Graybeal & Uhlir

[57] ABSTRACT

An earth digging tool is mounted on the head of a tripod, the legs of which are double-acting hydraulic cylinders. The rear ends of the cylinders are connected to a rotor which is supported in a tunneling shield for rotation about an axis extending longitudinally of the tunnel. The cylinders are selectively extended and retracted for the purpose of moving the cutting tool forwardly and rearwardly and also up and down and sideways. The entire excavator is rotated for changing the sideways attitude of the digging tool. Universal joints are provided at both ends of each hydraulic cylinder, for substantially isolating them from bending moments and torque. A telescopic torque tube assembly is interconnected between the cutting tool mounting head and a gimbal carried by the rotor. The torque tube carries the bending moments and torque loads and transmits them back to the rotor.

9 Claims, 15 Drawing Figures

Fig. 6
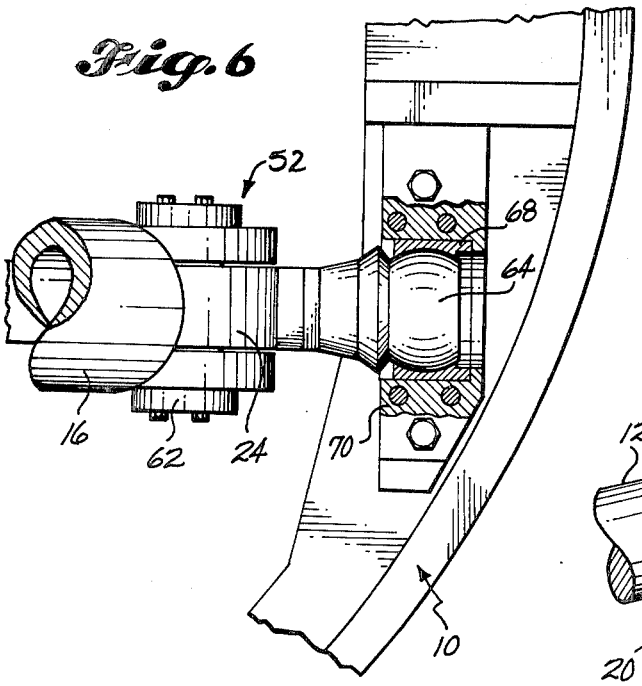
Fig. 7
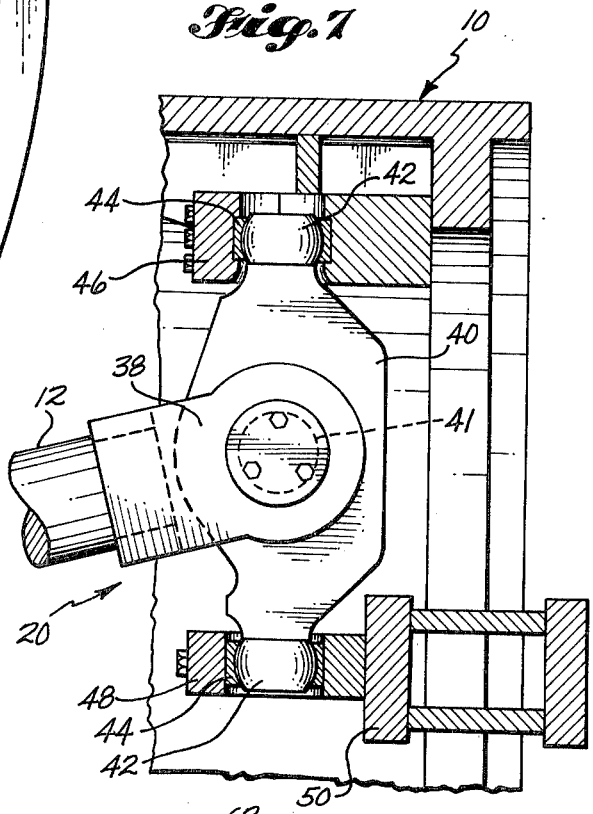
Fig. 8
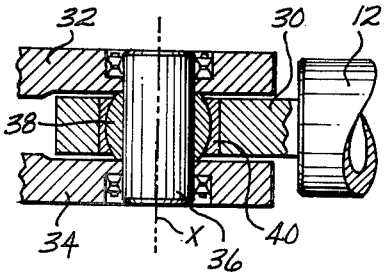
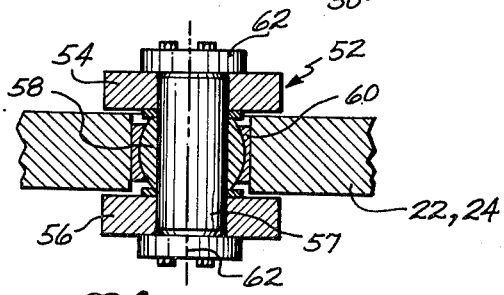
Fig. 9
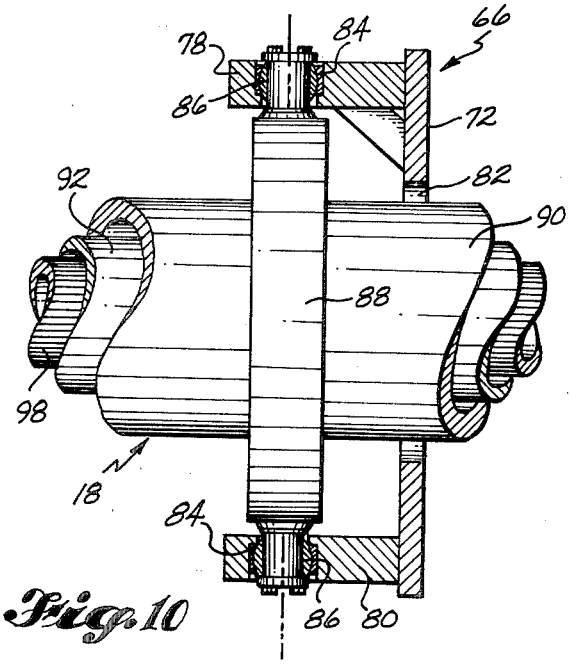
Fig. 10
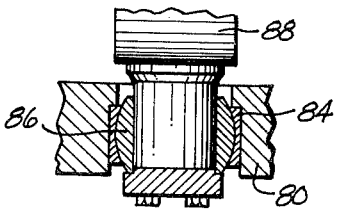
Fig. 11

EXCAVATOR FOR USE IN A TUNNELING SHIELD

BACKGROUND OF THE INVENTION

1. Field of the Invention

This invention relates to power excavating equipment and its arrangement within a tunneling shield.

2. Description of the Prior Art

The power excavating equipment of the present invention is similar to the power excavating equipment disclosed by U.S. Pat. No. 3,556,599, granted Apr. 11, 1975, to Tyman H. Fikse, in that forward and rear and up and down movements of a digging tool are effected by means of a multipod of double-acting hydraulic cylinders. U.S. Pat. No. 3,966,256, the several patents mentioned therein, and the prior art that was cited and/or considered by the Patent and Trademark Office and listed at the end of the patent should be consulted for the purpose of properly evaluating the subject invention and putting it into proper perspective.

U.S. Pat. No. 3,612,609, granted Oct. 12, 1971, to Josef Reuls discloses an excavator which comprises an elongated boom which is mounted at its rear end for universal movement and is moved up and down and sideways by a plurality of cylinders. However, the boom is extended and retracted by a hydraulic cylinder incorporated within the boom. The digging tool, the hydraulic cylinder within the boom, and its immediate support structure, are rotated within the boom for changing the sideways attitude of the digging tool. Additional patents which should be considered for the purpose of putting the present invention into proper perspective are U.S. Pat. No. 4,026,604, granted May 31, 1977 to Mitsuteru Motomura, Chiaki Kojima, Hiroshi Ohta and Akira Nemoto; U.S. Pat. No. 4,043,137, granted Aug. 23, 1977, to Hans Jutte, Siegmund H. F. L. M. Banbendererde, Adolf Foik and Reinhard E. J. Bokemeyer; and U.S. Pat. No. 4,070,772, granted Jan. 31, 1978, to Mitsuteru Motomura, Chiaki Kojima, Hiroshi Ohta and Akira Nemoto.

SUMMARY OF THE INVENTION

The excavating equipment of this invention is essentially characterized by a polypod type of support and drive mechanism for a digging tool which is mounted onto a rotatable support or rotor. The digging tool is mounted onto a head portion of the polypod mechanism. The legs of the polypod are double-acting hydraulic cylinders. Fluid is deliverd into and exhausted from the cylinders for the purpose of selectively lengthening and shortening the cylinders, to in that manner move the digging tool fore and aft in essentially all directions across the face of the tunnel, without a change in the sideways attitude of the digging tool. Rotation of the rotor provides a way of changing the sideways attitude of the digging tool.

According to an aspect of the invention, universal joints are provided at both ends of the hydraulic cylinders, for isolating such cylinders from all types of loading except axial or thrust loads. A torque tube assembly is provided for transmitting bending moments and torque from the support head back to the rotor.

Other aspects of the invention are hereinafter described in connection with the illustrated embodiment.

BRIEF DESCRIPTION OF THE DRAWING

In the drawing like letters and numerals refer to like parts, and:

FIG. 6 is an enlarged scale detailed view of a trunnion mount at one side of the excavating mechanism;

FIG. 7 is an enlarged scale detailed view of a gimbal mount for the rear end of the top cylinder;

FIG. 8 is an enlarged scale sectional view of an universal connection at the forward end of the top cylinder;

FIG. 9 is an enlarged scale sectional view of an universal joint at the rear end of a side cylinder;

FIG. 10 is an enlarged scale side elevational view, with some parts cut away and others in section, of a pivotal mount for the torque tube assembly;

FIG. 11 is a fragmentary detail view, partially in elevation and partially in section, of a trunnion mount for a torque tube support ring, such view being taken substantially along line 11—11 of FIG. 3;

DESCRIPTION OF THE PREFERRED EMBODIMENT

Figure 1:
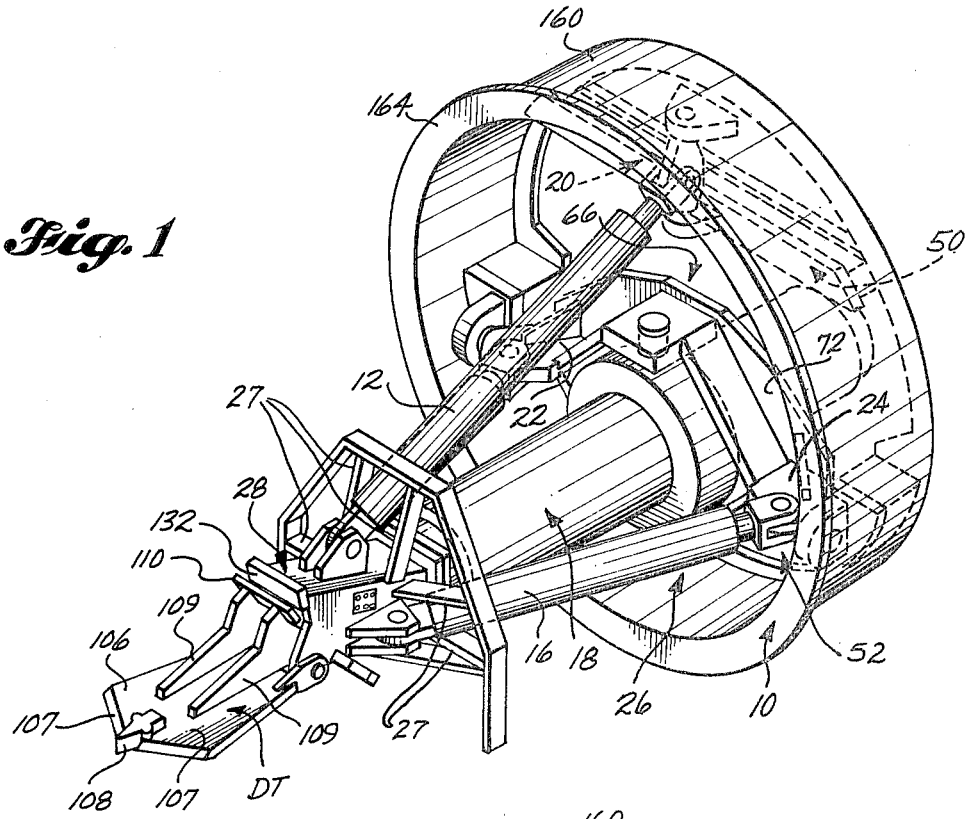
FIG. 1 is an isometric view looking from above and towards the front and one side of an excavating mechanism typifying the present invention, such view showing a digging tool in an approximately centered position.
Figure 2:
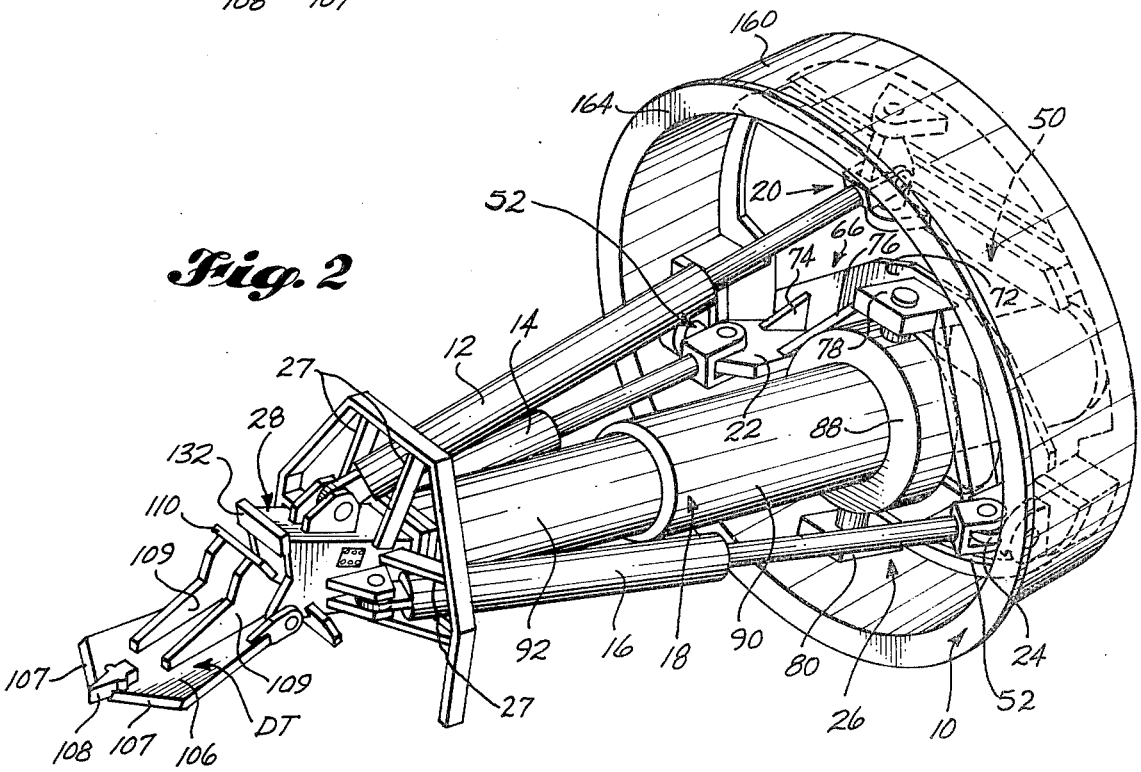
FIG. 2 is a view like FIG. 1, but showing the digging tool moved forwardly, upwardly and to one side of a centered position.

Referring first to FIGS. 1 and 2, a tool positioning assembly is shown to comprise a relatively large diameter rotor 10, a top cylinder 12, a right side cylinder 14, a left side cylinder 16 and a torque tube assembly 18.

The rear end of the top cylinder 12 is connected to an upper central portion of the rotor 10 by a gimbal type universal connector 20 (FIG. 7). The rear ends of the right and left side cylinders 14, 16 are pivotally connected to side plate portions 22, 24, respectively, of a larger gimbal assembly 26 which connects an intermediate rear portion of the torque tube assembly 18 to the rotor 10. The pivotal connections at the rear ends of side cylinders 14, 16 and the gimbal 26 cooperate to mount the rear ends of the side cylinders 14, 16 for universal movement.

The forward ends of the cylinders 12, 14, 16 extend between parallel plate members 27 which project outwardly from a support head shown in the form of a box beam 28 to which the digger tool DT is attached.

FIG. 8 shows in detail the pivotal connection at the front end of the top cylinder 12. The pivotal connections at the front ends of the side cylinders 14, 16 are identical so they will not be separately illustrated and described.

Referring now to FIG. 8, the cylinder 12 is shown to include a mounting end portion 30 which projects forwardly from the base of cylinder 12 into a space between a pair of parallel plates 32, 34 which are attached at their bases to an upper surface portion of the box beam 28. A pin 36 extends across such space and is supported at its ends by the plates 32, 34, in the manner illustrated. A ball bushing 38 is secured around a central portion of the pin 36 and has an outer surface of spherical configuration. A socket bushing 40 having an inner surface of matching spherical shape surrounds and engages the ball bushing 38. Socket bushing 40 is received within a transverse opening formed in the mounting end portion 30 of cylinder 12. The ball and socket bushing members 38, 40 mount the front end of cylinder 12 for pivotal movement about the axis of pin 36, and due to the spherical nature of their contacting surfaces they also mount it for limited angular movement from side to side between the two mounting plates 32, 34.

The axes of the pins 36 lie in a common plane. Imagine a circle inscribed within said plane, closely about the forward end connections of the three cylinders 12, 14, 16. Now imagine the axes X of the pins 36 being extended until they intersect the circle. These axes X would then lie on chords of the circle. Hence, it can be said that the forward ends of the cylinders 12, 14, 16 are connected to the tool mounting head 28 for moving about chordwise axes. This statement would also be accurate if the mounting means for the top cylinder 12 were to be moved either forwardly or rearwardly, moving its axis X out of a common plane with the pivotal axes of the two side cylinders 14, 16. The statement is also true with respect to the pivotal axes at the rear ends of the three cylinders 12, 14, 16; they also are chordwise axes.

Referring now to FIG. 7, the rear or rod end of top cylinder 12 is shown to include a clevis 38 having spaced apart side parts between which a mid-portion of a spindle 40 is received. A pivot pin 41 extends between the two side parts and through the spindle 40. A ball bushing is carried by the midportion of the pin 41 and it is received within a socket bushing carried by the spindle 40. FIG. 9, relating to a pivotal connection at the rear end of one of the side cylinder 14, 16 is also an accurate showing of a section taken through the pivot joint connection between yoke 38 and spindle 40.

Spindle 40 includes a ball-like trunnion 42 at each of its ends which is received within a complementary socket bushing 44 which is in turn retained within an opening in a mounting arm 46, 48. Upper arm 46 may be directly connected to the rotor 10. Lower arm 48 may be attached to the mid-portion of a box beam 50 which extends in chordwise fashion across an upper rear portion of the rotor 10.

As mentioned above, FIG. 9 is a detail of the connection between a yoke 52 at the rear end of a side cylinder 14, 16 and plate portions 22, 24 of the gimbal 26. Yoke 52 includes spaced apart side portions 54, 56 defining a space between them in which a portion of the plate 22, 24 is received. A pin 57 extends between members 54, 56 and through the member 22, 24. A ball bushing 58 surrounds the pin 57 and is received within a socket bushing 60. Socket bushing 60 is received within an opening formed in side plate portions 22, 24. End caps 62 may be provided for retaining the pin 57 in place. Cap 62 may be connected to the opposite ends of the pins 57 by means of a plurality of bolts, as shown.

As shown by FIG. 6, a ball shaped trunnion 64 is provided at each end of the large yoke portion 66 of gimbal 26. The ball trunnions 64 are received within sleeve bushings 68 which are in turn received in and retained by a suitable mounting structure 70.

Referring to FIGS. 1 and 2, the ball trunnions 64 are integrally connected to the plate members 22, 24 which are in turn connected to opposite end portions of a centrally open rear wall portion 72 of the yoke 66. Triangular gusset plates 74, 76 may extend between the rear wall 72 and the side plates 22 and 24 to provide reinforcement for the yoke 36. Upper and lower support arms 78, 80 project forwardly from the wall 72, above and below the aperture 82. These support arms 78, 80 carry socket bushings 84 which engage ball trunnions 86 which are connected to upper and lower portions of an annular ring 88, at diametrically opposed positions. The annulus 88 surrounds and is connected to an outer tube portion 90 of the torque tube assembly 18. The ball and socket joints 84, 86 connect the torque tube assembly 18 to the yoke 66 for sideways movement about a vertical axes. The ball and socket joint connections 64, 68 at the opposite ends of the yoke 66 mount the torque tube assembly for up and down pivotal movement about a horizontal axis.

Figures 3, 4, 5:
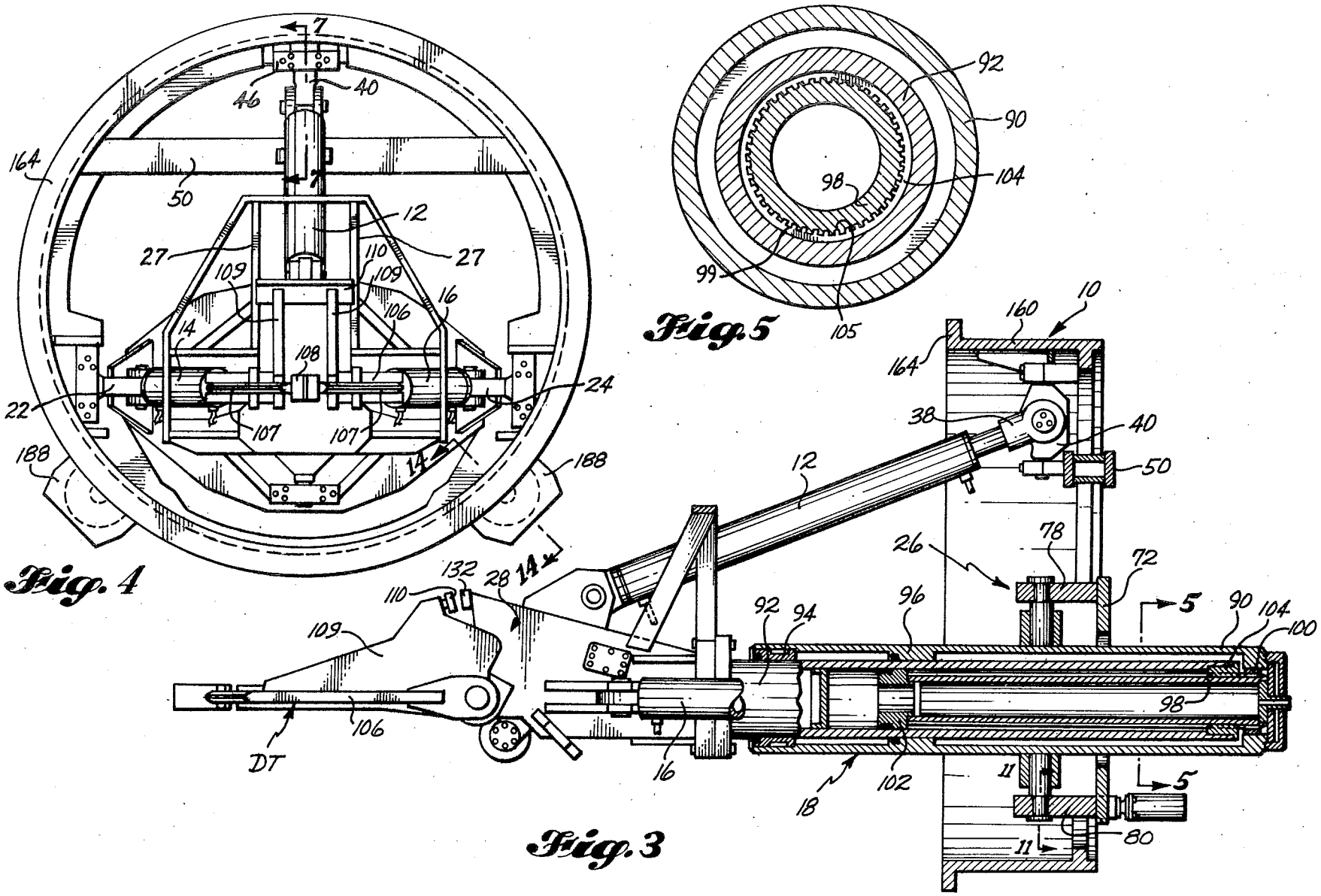
FIG. 3 is an enlarged scale side elevational view of the excavating mechanism, with the foreground side cylinder cut away and the rearward portion of such mechanism shown in axial section.
FIG. 4 is an enlarged scale front elevational view of the excavating mechanism.
FIG. 5 is a sectional view through the torque tube assembly, taken substantially along line 5—5 of FIG. 3.

Referring now to FIG. 3, the outer tube 90 of torque tube assembly 18 is gimbaled to the rotor 10 by means of the gimbal assembly 26.

A forward tube 92 extends rearwardly into the outer tube 90. Tube 90 carries a pair of axially spaced apart slide bearings 94, 96 which engage and support the forward tube 92 for fore and aft sliding movement. The outer tube 90 is rigidly connected at its rearward end to the rearward end of an inner tube 98. For example, a connector ring 100 having radially inwardly directed spines may be secured to the rear end of the outer tube 90. The inner tube 98 may have external splines 99 extending throughout most of its length. the splines on ring 100 are shown in engagement with the rear portions of such splines. The forward end of tube 98 includes a slide bearing 102 which engages the inner diameter of forward tube 92 and helps guide the tubes 92, 98 as they slide relative to each other. Another ring 104 also having radially inwardly directed splines 105 is secured to the rear end of forward tube 92. Such splines engage the external splines on inner tube 98 throughout the full length of travel of ring member 104.

The rear end connection, including connector ring 100, connect the outer and inner tubes 90, 98 together such that neither will rotate relative to the other. The spline connection 99, 105 between ring 104 and the external splines on tube 98 prevent relative rotation between tubes 92 and 98. Thus, the sliding spline connection 99, 105 between forward tube 92 and inner tube 98 is capable of carrying torque. And, any torque loads imposed on the digging tool DT, or on any other forward portion of the excavator assembly, are transmitted rearwardly through the telescopic torque tube assembly 18 to the gimbal assembly 26 and by the gimbal assembly 26 to the rotor 10. Specifically, any torque composed on forward tube 92, such as by a particular loading of the digging tool DT during a digging operation, is transmitted by the spline connection 99, 105 to the inner tube 98. It is then transmitted to the outer tube 90, by reason of the fixed connected between the rear end portions of tubes 98 and 90, and from outer tube 90 to the gimbal assembly 26. The interior of the torque tube assembly 18 is vented, so that the torque tube assembly 18 will not draw or compress air during extension and retraction.

Hydraulic fluid is introduced into and exhausted out from the cylinders 12, 14 and 16, all of which are double-acting hydraulic cylinders. Preferably, the cylinders 12, 14, 16 are operated in the same manner as the three cylinders or cylinder sets in the mechanisms disclosed by the aforementioned U.S. Pat. No. 3,966,256. In other words, any extension of the three cylinders as a group will move the digger tool DT forwardly. Retraction of all three cylinders will move the digger tool DT rearwardly. Differential movement of the type described in detail in U.S. Pat. No. 3,966,256 will move the digger tool DT up or down and/or sideways. A preferred hydraulic circuit and a preferred electro-hydraulic control circuit are disclosed in detail in U.S. Pat. No. 3,966,256 and for that reason will not be repeated herein.

In the excavator mechanism of the present invention the torque is transmitted from the digging tool DT to the tunneling machine frame by means of the torque tube assembly 18, the gimbal assembly 26, the rotor 10, and the drive mechanism for the rotor 10. The several pivot joints which have been described above include ball and socket type sleeve bushings which serve to isolate the hydraulic cylinders from torque and any moments.

Referring now to FIGS. 1, 2, 3, and 15, in particular, the digging tool DT is shown to include a flat spade portion 106. It includes a two-part cutter edge 107. The two parts are located on opposite sides of a central tooth or point 108. The cutting edge parts 107 may sweep rearwardly, as illustrated, to give the cutting edge a relatively shallow V-shape. A pair of generally triangular gussets 109 are attached along their lower edges to the upper surface of the flat spade portion of the digging tool DT. A transverse bumper 110 is connected to upper rear portions of the gussets 109. Lower rear portions of the gussets 109 are pivotally connected to forward side wall portions of the box beam or tool head 28, for pivotal movement about a transverse axis. In preferred form the pivot joint means includes a transverse pivot pin 112 which may be termed a wrist pin.

Figure 15:
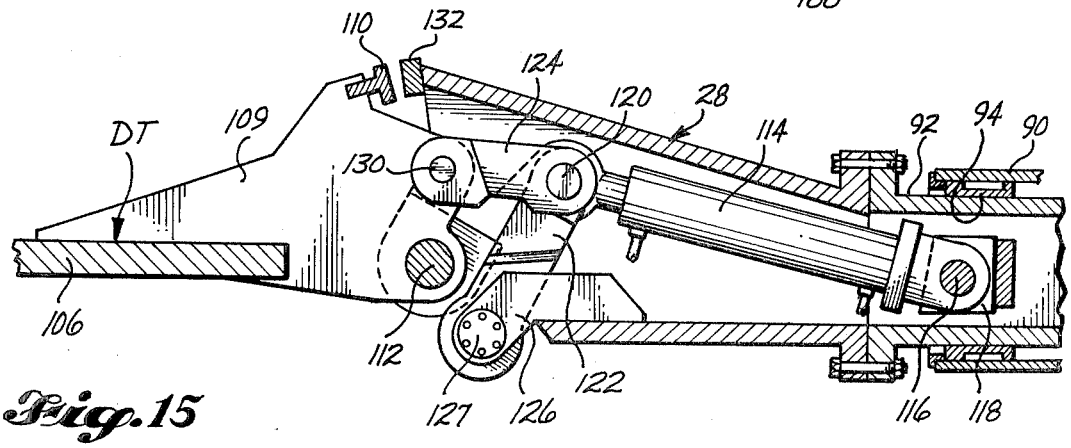
FIG. 15 is an enlarged scale fragmentary view of the mechanical linkage and hydraulic cylinder mechanism which is used for swinging the digging tool through its arc of travel.

As best shown by FIG. 15, a double-acting hydraulic control cylinder 114 is housed within the box beam 28 and a forward portion of the forward torque tube 92. The rear end of cylinder 114 is pivotally connected, such as by means of a pivot pin 116, to a fixed support 118 located within tube 92. The forward end of cylinder 114 is pivotally connected, such as by means of a transverse pivot pin 120, to both the upper end of control linkage 122 and the rear end of control linkage 124. The lower ends of linkage 122 are pivotally connected to brackets 126 located at a front end of box beam 28 through the use of pivot pins 127. The forward end of control linkage 124 is pivotally connected to rear portions of the gussets 109, at a location generally between the wrist pin 112 and the bumper 110 through the use of pivot pins 130. All of the axes of pivot pins 112, 116, 120, 127, 130 are all parallel to each other.

Figure 12:
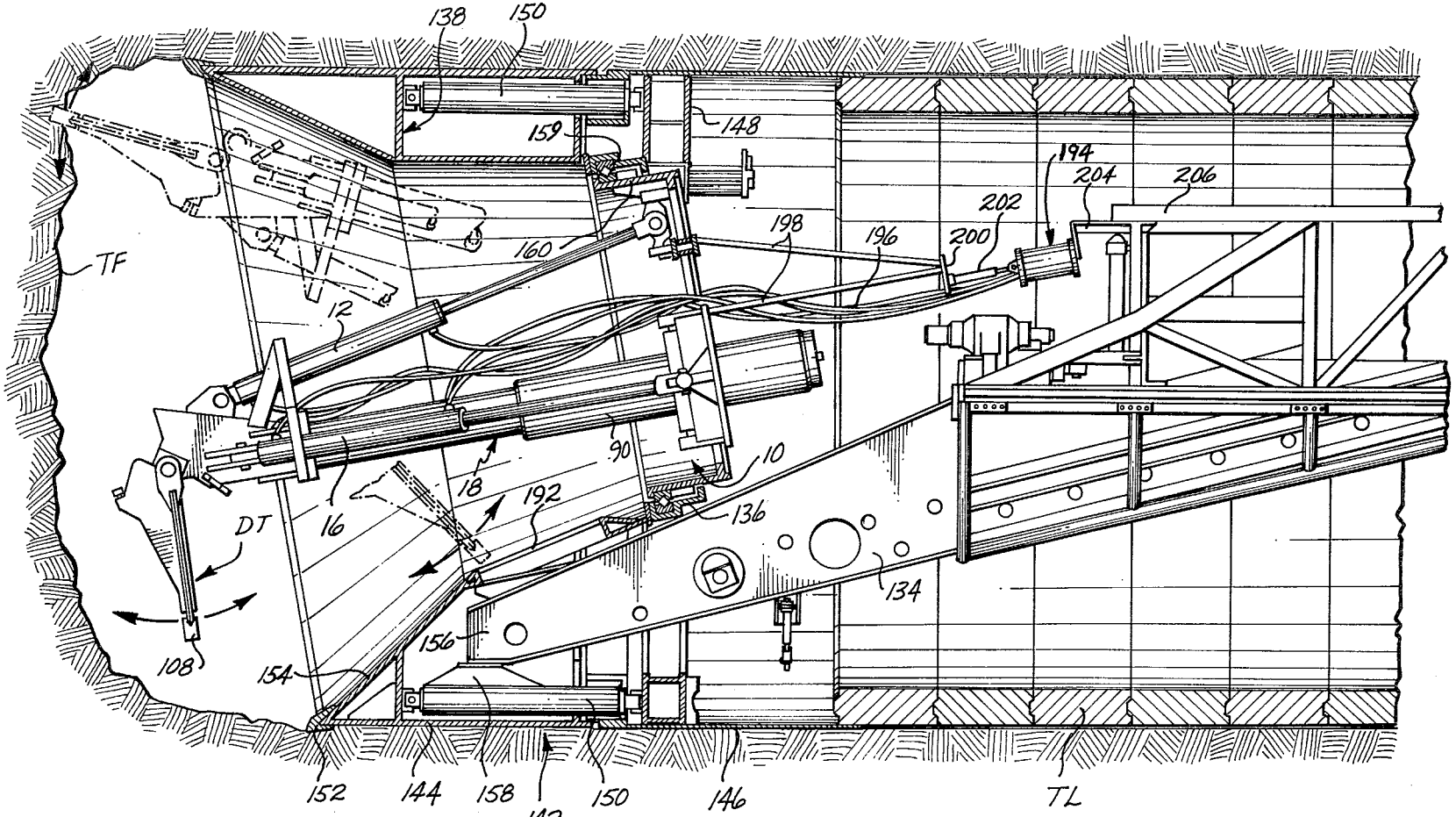
FIG. 12 is a longitudinal vertical sectional view of a tunneling machine equipped with an excavating mechanism of the type shown by FIGS. 1–11, with some parts in side elevation, said view including a solid line showing of the excavating mechanism in a substantially centered position, with its digging tool directed downwardly, a fragmentary phantom line showing of such digging tool in a retracted position and a phantom line showing of the excavator mechanism raised and its digging tool directed forwardly.

Retraction or shortening of the control cylinder 114 will cause the digging tool DT to rotate clockwise about the axis of pin 112 until further movement is prevented by the bumper 110 making abutting contact with a transverse stop member 132 located at the upper forward boundary of the box beam 28. When bumper 110 is tight against stop member 132 the plane of the spade 106 is substantially coincident with the center line axis of the torque tube assembly 18 (FIG. 3). Extension or elongation of the cylinder 114 rotates the digging tool DT in the counterclockwise direction. As shown by FIG. 12, the digging tool DT can be rotated counterclockwise into a position whereat it is generally perpendicular to the axis of the torque tube assembly 18, or even rearwardly an additional amount, so that it can be used as a "hoe" or "drag element" for moving excavated material rearwardly up onto a conveyor belt housed within a support frame 134 (FIG. 12).

When the lengths of cylinders 12, 14, 16 and 114 are held constant, the digging tool DT is held rigid by such cylinders 12, 14, 16, 114 and, by selective operation of such cylinders 12, 14, 16, the digging tool DT can be extended towards the work face and traversed in any desired direction over the work face, or when rotated downwardly can be pulled rearwardly.

Figure 13:
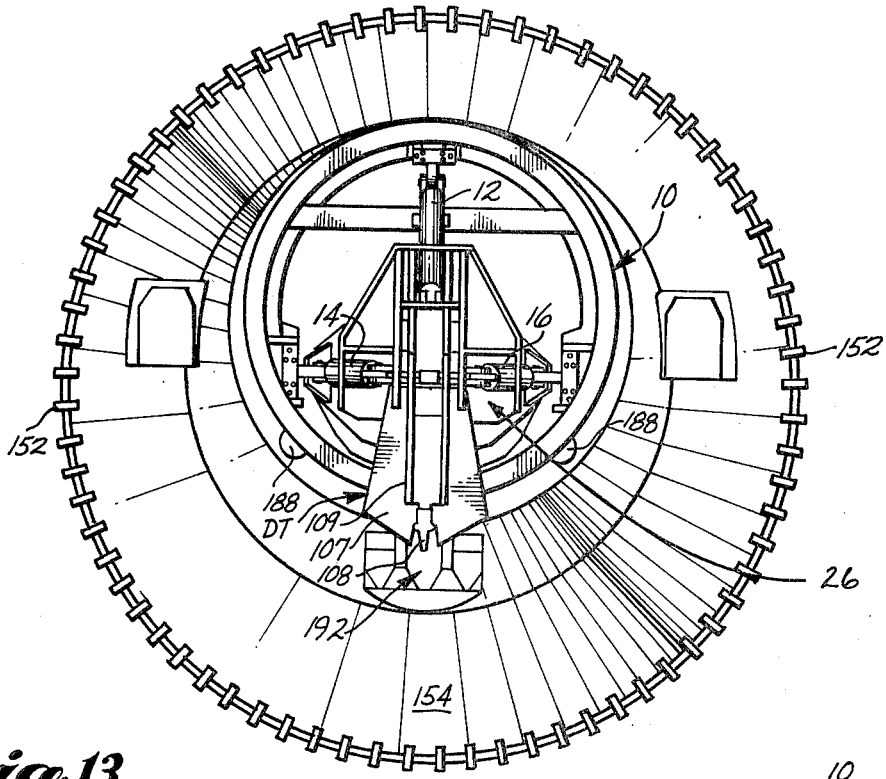
FIG. 13 is a front elevational view of the tunneling machine shown by FIG. 12.
Figure 14:
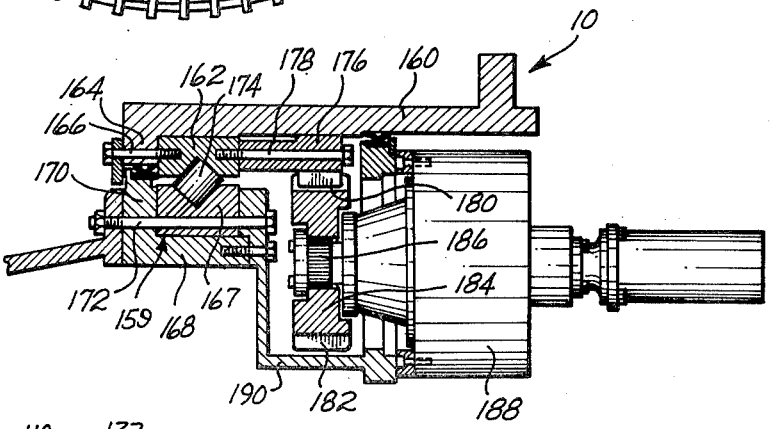
FIG. 14 is an enlarged scale fragmentary sectional view, taken substantially along line 14—14 of FIG. 4, said view presenting a drive motor in side elevation.

Referring now to FIGS. 12–14, in particular, the rotor 10 is shown to be mounted for rotation within a central ring beam portion 136 of a support frame 138 for a shield 142. The shield 142 is shown to comprise a forward section 144 in axial alignment with a tail or rear section 146. A thrust ring 148 is located within the tail section 146. A ring of thrust cylinders 150 housed within a peripheral portion of the frame 138 include rearwardly directed rod portions which are connected to thrust ring 148. Cylinders 150 are double-acting hydraulic cylinders. When they are extended they move the thrust ring 148 rearwardly. When they are retracted they pull the thrust ring 148 forwardly.

The illustrated embodiment is adapted for constructing a tunnel lining TL from interfitting segments. The segments are transported forwardly through the tunnel and are assembled into a ring within a space rearwardly of the thrust ring 148. Then, the cylinders 150 are extended to move the thrust ring 148 rearwardly for pushing the tunnel lining segments into place. The cylinders 150 are also employed for moving the tunneling shield 142 forwardly.

The tunneling shield 142 has a forwardly directed peripheral cutting edge 152. A frusto-conical wall extends rearwardly from the cutting edge 152 and in its lower extent defines a rearwardly and upwardly sloping apron 154. A forward end portion 156 of the conveyor frame 134 is secured to a forward portion 158 of the shield frame 138.

The rotor 10 is mounted for rotation by means of a large diameter combination bearing 159, located between ring beam 136 and a cylindrical peripheral wall portion 160 of rotor 10. As best shown by FIG. 14, a radially inner bearing race 162 is secured to the cylindrical wall 160, immediately rearwardly of a forward radial wall 164. A plurality of bolts 166 may extend axially through wall 164 and thread into internal openings formed in race 162. A radially outer bearing race 167 is shown positioned radially inwardly of a cylindrical wall portion 168 of the frame ring 136, immediately rearwardly of another forward radial wall 170. Race 167 may be held in place by means of bolts 172, extending axially through both it and the radial wall 170. Roller elements 174 are located between the bearing races 162, 167. As is known in the art, the axes of the rollers 174 are set at an angle to the bearing axis, so that the bearing can carry both axial and radial loads.

A large diameter gear 176 is shown positioned immediately axially rearwardly of race 162, and immediately radially outwardly of cylindrical wall 160. Gear 176 may be secured in place by means of a plurality of bolts 178 extending axially through it and threading into internally threaded openings formed in the race 162.

As shown by FIG. 14, gear 176 has radially outwardly directed teeth 180 which mesh with the teeth 182 of a drive gear 184. The drive gear 184 is connected to the output shaft 186 of a drive motor 188. In the illustrated embodiment two drive motors 188 are provided. They are located on opposite sides of the machine, generally vertically below the location of the trunnion mounts 64, 68 when the excavator is in an upright position, such as is shown by FIGS. 1–4, 12 and 13. Each drive motor 188 is secured to a mounting bracket 190 which is secured to the frame ring 168, in the manner best illustrated by FIG. 14. The drive motors 188 drive the drive gears 184 and they in turn drive the larger diameter gear 176 and the rotor 10 of which it is a part.

As earlier explained, the cylinders 12, 14, 16 move the digging tool DT forwardly and rearwardly and up and down across the tunnel face. Rotation of the rotor 10 changes the sideways angular attitude of the spade 106. If desired, the digging tool DT could be put into the attitude shown in broken lines in FIG. 12. The three cylinders 12, 14, 16 could be extended for the purpose of moving the cutting edge 107 and tooth 108 into the tunnel face TF. Following the desired amount of penetration, the cylinders 12, 14, 16 could be retracted an amount sufficient to clear the digging tool DT from the tunnel face TF. Then, the rotor 10 could be rotated a few degrees for the purpose of relocating the digging tool DT into a new position whereat its cutting edge 107 and tooth 108 could make another cut which would be a continuation of the last cut. If desired, this procedure could be repeated for a full three hundred and sixty degrees or any part thereof.

As shown by FIG. 12, after a substantial amount of material has been dug loose from the tunnel face TF, the excavating mechanism may be rotated into its upright position and the cylinder 114 be extended to move the digging tool DT down into the position shown by solid lines in FIG. 12. Next, the excavating mechanism may be lowered, if not already, to place the digging tool DT into material accumulated forwardly of the apron 154. Then, the cylinders 12, 14, 16 may be retracted for the purpose of drawing the digging tool DT rearwardly and upwardly along the apron 154, so as to draw any material in its path upwardly and rearwardly. After it reaches the top of the apron the material would fall through an opening 192 and onto the conveyor.

Owing to the above described construction of the excavating mechanism, the three cylinders 12, 14, 16 carry and transmit axial loads only. The bending and torque loads are transmitted rearwardly by the torque tube assembly 18. The cylinders 12, 14, 16 are active drive elements; they alone control all front to rear and up and down movement of the mounting head 28 for the digging tool DT. The torque tube assembly 18 is passive with respect to positioning of the mounting head 28 and the digging tool DT. It exists in the system for the purpose of carrying moments and torque. Its presence in the system allows the use of universal joints at both ends of each cylinder 12, 14, 16, for the purpose of isolating the cylinders 12, 14, 16 from all loads other than axial or thrust loads.

Hydraulic fluid for operating the cylinders 12, 14, 16, 114 and the hydraulic motors 188 may be delivered to a stationary portion of a swivel 194. The rearward ends of the hydraulic fluid conduits, some of which are designated 196 in FIG. 12, are connected to ports carried by a rotating annular portion of the swivel 194. The rotating portion of the swivel 194 may be supported by a truss 198 comprising members which are attached at their forward ends to a portion of the rotor 10 and at the rearward ends to a plate 200 to which a shaft 202 connected to the rotational part of the swivel 194 is also connected. The stationary inner part of the swivel 194 is connected to a bracket 204 which in turn is attached to a rear frame structure 206.

The embodiment which is illustrated in the drawing and described above is illustrative of the invention and constitutes the best mode of the invention. However, it is to be understood that the invention is not to be limited to the details of the structure that has been illustrated and described, but rather is to be determined by the following claims.

What is claimed is:

1. An excavating mechanism for a tunneling machine that is advanced through the ground as excavating proceeds, of a type comprising a combination digging and dragging tool and a multipod support for said tool comprising a tool mounting head and at least three double-acting hydraulic cylinders forming three variable length support and drive legs, which are operable to extend and retract the tool and move it up and down and sideways over the tunnel face, and the improvement comprising:

a rotor which in use is supported within the tunneling machine for rotation about an axis which extends longitudinally of the tunnel;

means connecting the rear ends of the hydraulic cylinder support and drive legs to the rotor, said connecting means permitting only axial and thrust loads to be transmitted between said hydraulic cylinder support and drive legs and said rotor;

means for transmitting bending moments and torque loads from the tool support head back to the rotor; and means for rotating said rotor to change the sideways attitude of the tool.

2. An excavating mechanism, according to claim 1, wherein the means for transmitting bending moments and torque loads from the tool mounting head back to the rotor comprises a telescoping member extending rearwardly from the tool support head to the rotor, and yoke means for interconnecting the rearward end of said telescoping member to simultaneously transfer torque loads imposed on the tool back to the rotor and permit universal relative angular movement between the telescoping member and the rotor.

3. An excavating mechanism according to claim 2, wherein the telescoping member comprises:

a torque tube assembly including a first tube which is fixedly attached at its forward end to the tool mounting head and extends rearwardly therefrom, a second torque tube which is telescopically engageable with the first tube, and spline means interconnecting the two tubes for transmitting torque while permitting axial sliding movement of two tubes relative to each other; and, yoke means pivotally interconnected with the second torque tube about a first axis of rotation extending perpendicularly to the length of said telescopic member and with the rotor about a second axis of rotation which is perpendicular to both the length of the telescopic member and the first axis of rotation about which the second torque tube and the yoke pivot relative to each other.

4. An excavating mechanism for a tunneling machine that is advanced through the ground as excavating proceeds, of a type comprising a combination digging and dragging tool and a multipod support for said tool comprising a tool mounting head and at least three double-acting hydraulic cylinders forming three variable length support and drive legs, which are operable to extend and retract the tool and move it up and down and sideways over the tunnel face, and the improvement comprising:

a rotor which in use is supported within the tunneling machine for rotation about an axis which extends longitudinally of the tunnel;

means connecting the rear ends of the hydraulic cylinder support and drive legs to the rotor;

means for transmitting bending moments and torque loads from the tool support head back to the rotor;

means for rotating said rotor to change to sideways attitude of the tool; and, wherein the means for transmitting bending moments and torque loads from the tool mounting head back to the rotor comprises a telescopic torque tube assembly including a first tube which is fixed at its forward end to the tool mounting head and extends rearwardly therefrom, a second tube which is telescopically engageable with the first tube, spline means between the two tubes for transmitting torque while permitting axial sliding movement of each tube relative to the other, and means mounting a rear portion of the second tube onto the rotor for universal movement relative to the rotor.

5. An excavating mechanism according to claim 4, wherein each hydraulic cylinder support and drive leg for the tool includes universal joint means at each of its ends, isolating such ends from moments and torque loads.

6. An excavating mechanism according to claim 4, wherein the means mounting the rear portion of the second tube onto the rotor for universal movement relative to the rotor comprises a third tube concentrically surrounding the second tube and defining therewith an annular space between the tubes, means securing rear portions of said second and third tubes together, and wherein said first tube is telescopically received within the third tube and about the second tube, and gimbal means interconnected between the third tube and the rotor.

7. An excavating mechanism according to claim 6, wherein each hydraulic cylinder support and drive leg for the tool includes universal joint means at each of its ends, isolating such ends from moments and torque loads.

8. An excavating mechanism according to claim 7, wherein said multipod support comprises three hydraulic cylinder support and drive legs, with two of said legs connecting at their front ends to side portions of the tool mounting head and at their rear ends to side portions of the gimbal means, and wherein the third hydraulic cylinder support and drive leg is connected at its forward end to an upper part of the tool mounting head, and universal joint means connecting the rear end of said third hydraulic cylinder support and drive leg to an upper portion of the rotor.

9. An excavating mechanism according to claim 8, comprising second gimbal means connecting the rear end of the third hydraulic cylinder and support leg to the upper portion of the rotor.

* * * * *